US009126782B2

(12) United States Patent
Abe et al.

(10) Patent No.: US 9,126,782 B2
(45) Date of Patent: Sep. 8, 2015

(54) TRANSPORTING DEVICE, AND IMAGE FORMING APPARATUS

(71) Applicant: FUJI XEROX CO., LTD., Tokyo (JP)

(72) Inventors: Takashi Abe, Kanagawa (JP); Yusuke Itozaki, Kanagawa (JP); Shouichi Maeda, Kanagawa (JP); Takuya Mori, Kanagawa (JP); Yoshinori Shuin, Kanagawa (JP); Koki Adachi, Kanagawa (JP); Yuki Kawazoe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 2 days.

(21) Appl. No.: 14/196,530

(22) Filed: Mar. 4, 2014

(65) Prior Publication Data

US 2015/0014921 A1 Jan. 15, 2015

(30) Foreign Application Priority Data

Jul. 12, 2013 (JP) ..... 2013-146903

(51) Int. Cl.

| | |
|---|---|
| ***B65H 1/08*** | (2006.01) |
| ***B65H 1/04*** | (2006.01) |
| ***B65H 1/12*** | (2006.01) |

(52) U.S. Cl.

CPC .. *B65H 1/08* (2013.01); *B65H 1/04* (2013.01); *B65H 1/12* (2013.01); *B65H 2405/114* (2013.01); *B65H 2405/1117* (2013.01)

(58) Field of Classification Search

USPC ..... 271/126, 127, 171

See application file for complete search history.

(56) References Cited

U.S. PATENT DOCUMENTS

| | | | | |
|---|---|---|---|---|
| 5,114,133 | A * | 5/1992 | Osada et al. | 271/22 |
| 6,116,591 | A * | 9/2000 | Kim | 271/171 |
| 6,435,499 | B1 * | 8/2002 | Tomatsu | 271/147 |
| 7,364,153 | B2 * | 4/2008 | Takahashi et al. | 271/127 |
| 8,746,683 | B2 * | 6/2014 | Yamamoto | 271/171 |
| 2012/0119434 | A1 * | 5/2012 | Ueda et al. | 271/147 |

FOREIGN PATENT DOCUMENTS

| | | |
|---|---|---|
| JP | A-06-009068 | 1/1994 |
| JP | A-2007-112564 | 5/2007 |

* cited by examiner

*Primary Examiner* — Jeremy R Severson

(74) *Attorney, Agent, or Firm* — Oliff PLC

(57) ABSTRACT

Provided is a transporting device including a transport section that contacts with a material to be transported and that transports the material to be transported, a table on which the material to be transported is placed, a moving member that includes the table provided on an upper surface of the moving member so that an upper surface of the table is higher than the upper surface of the moving member in a vertical direction and moves the material to be transported, which is placed on the table, to a contact position where the material to be transported contacts with the transport section, and a positioning member that contacts with an end portion of the material to be transported in a width direction orthogonal to a transport direction in which the material to be transported is transported by the transport section.

8 Claims, 7 Drawing Sheets

TRANSPORTING DEVICE, AND IMAGE FORMING APPARATUS

CROSS-REFERENCE TO RELATED APPLICATIONS

This application is based on and claims priority under 35 USC 119 from Japanese Patent Application No. 2013-146903 filed Jul. 12, 2013.

BACKGROUND

Technical Field

The present invention relates to a transporting device, and an image forming apparatus.

SUMMARY

According to an aspect of the invention, there is provided a transporting device including:

a transport section that contacts with a material to be transported and that transports the material to be transported;

a table on which the material to be transported is placed;

a moving member that includes the table provided on an upper surface of the moving member so that an upper surface of the table is higher than the upper surface of the moving member in a vertical direction and moves the material to be transported, which is placed on the table, to a contact position where the material to be transported contacts with the transport section; and a positioning member that contacts with an end portion of the material to be transported in a width direction orthogonal to a transport direction in which the material to be transported is transported by the transport section, wherein the positioning member includes an arranging part arranged at a position where the arranging part contacts with the moving member and a gap is formed between the moving member and the transport section when the moving member is moved toward the contact position, and wherein the table is provided at a position nearer to the material to be transported than the positioning member in the width direction and overlaps the transport section when being viewed in the vertical direction.

BRIEF DESCRIPTION OF THE DRAWINGS

Exemplary embodiments of the present invention will be described in detail based on the following figures, wherein.

DETAILED DESCRIPTION

Hereinafter, an exemplary embodiment related to the invention will be described with reference to the drawings.

Configuration of Image Forming Apparatus 10

Figure 1:
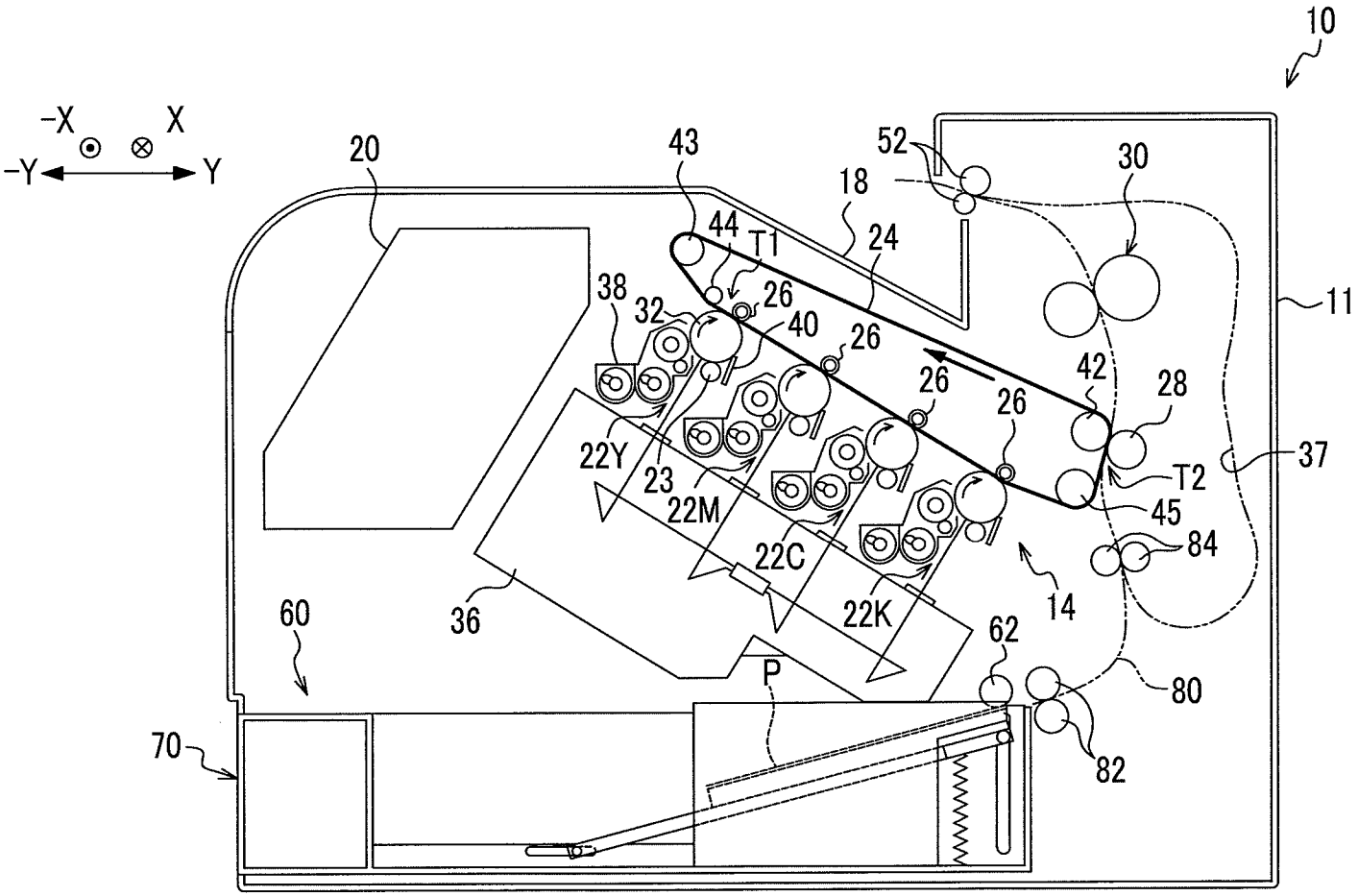
FIG. 1 is a schematic view showing the configuration of an image forming apparatus related to the present exemplary embodiment.

First, the configuration of an image forming apparatus related to the present exemplary embodiment will be described. FIG. 1 is a schematic view showing the configuration of the image forming apparatus 10 related to the present exemplary embodiment. In addition, an X direction, a −X direction, a Y direction, and a −Y direction to be used in the following description are arrow directions shown in the drawings.

The image forming apparatus 10, as shown in FIG. 1, includes an image forming apparatus body 11 (housing) in which respective component parts are provided. Here, a material that is transported by a transporting device is referred to as a material to be transported. A transporting device 60 that transports a recording medium P (an example of the material to be transported), an image forming section 14 that forms an image on the recording medium P transported by the transporting device 60, and a control section 20 that controls the operation of the respective sections of the image forming apparatus 10 are provided inside the image forming apparatus body 11. Additionally, an ejection section 18 to which the recording medium P on which the image is formed by the image forming section 14 is ejected is provided in an upper portion of the image forming apparatus body 11.

The image forming section 14 includes image forming units 22Y, 22M, 22C, and 22K (hereinafter referred to as 22Y to 22K) that forms toner images in respective colors of yellow (Y), magenta (M), cyan (C), and black (K), an intermediate transfer belt 24 to which the toner images formed by the image forming units 22Y to 22K are transferred, first transfer rolls 26 as first transfer members that transfer the toner images formed by the image forming units 22Y to 22K to the intermediate transfer belt 24, a second transfer roll 28 as a second transfer member that transfers the toner images transferred to the intermediate transfer belt 24 by the first transfer rolls 26 from the intermediate transfer belt 24 to the recording medium P, and a fixing device 30 that fixes the toner images transferred from the intermediate transfer belt 24 to the recording medium P by the second transfer roll 28 onto the recording medium P.

In addition, the image forming section 14 is not limited to the above configuration, and may have any configuration when an image is formed on the recording medium P.

The image forming units 22Y to 22K are arranged side by side in the image forming apparatus body 11 in a state that the image forming units incline with respect to the Y direction. Additionally, the image forming units 22Y to 22K have photoconductors 32 that rotate in one direction (for example, a clockwise direction in FIG. 1), respectively. In addition, since the image forming units 22Y to 22K are similarly configured, symbols of respective portions of the image forming units 22M, 22C, and 22K will be omitted in FIG. 1.

Around each photoconductor 32, a charging roll 23 as a charging device that charges the photoconductor 32, a developing device 38 that develops an electrostatic latent image formed on the photoconductor 32 to form a toner image as an exposure device 36, to be described below, exposes the photoconductor 32 charged by the charging roll 23, and a removal device 40 that removes residual toner that remains on the photoconductor 32 are provided sequentially from the upstream side in the rotational direction of the photoconductor 32.

The exposure device 36 that exposes the photoconductors 32 charged by the charging rolls 23 and forms electrostatic latent images on the photoconductors 32 is provided obliquely below the image forming units 22Y to 22K. The exposure device 36 forms the electrostatic latent images on the basis of image signals sent from the control section 20. As image information sent from the control section 20, for example, there is image information that is generated by an external device and acquired by the control section 20 from the external device, image information generated by reading images, such as an original document, in the image forming apparatus 10, or the like.

The intermediate transfer belt 24, as shown in FIG. 1, is annularly formed and is arranged obliquely above the image forming units 22Y to 22K. Winding rolls 42, 43, 44, and 45 around that the intermediate transfer belt 24 is wound are provided on the inner peripheral side of the intermediate transfer belt 24. The intermediate transfer belt 24, for example, is adapted to perform a circulation movement (rotation) in one direction (for example, counterclockwise direction in FIG. 1) while contacting with the photoconductors 32, as the winding roll 43 rotates. In addition, a facing roll that faces the second transfer roll 28 across the intermediate transfer belt 24 is used as the winding roll 42.

The first transfer rolls 26 face the photoconductors 32, respectively, across the intermediate transfer belt 24. The first transfer rolls 26 are adapted to transfer the toner images formed on the photoconductors 32 to the intermediate transfer belt 24 by the application of a transfer voltage (transfer bias). Positions between the first transfer rolls 26 and the photoconductors 32 are defined as first transfer positions T1 where the toner images formed on the photoconductors 32 are transferred to the intermediate transfer belt 24.

The second transfer roll 28 faces the winding roll 42 across the intermediate transfer belt 24. The second transfer roll 28 transfers the toner images transferred to the intermediate transfer belt 24 to the recording medium P, by the application of a transfer voltage (transfer bias). A position between the second transfer roll 28 and the winding roll 42 is defined as a second transfer position T2 where the toner images transferred to the intermediate transfer belt 24 are transferred to the recording medium P.

The transporting device 60 transports the recording medium P, which is accommodated in an accommodating section 70 to be described below, to the second transfer position T2. In addition, the specific configuration of the transporting device 60 will be described below.

The fixing device 30 fixes the toner images transferred at the second transfer position T2 to the recording medium P transported from the second transfer position T2. An ejection roll 52 that ejects the recording medium P, on which the toner images are fixed, to the ejection section 18 is provided further toward the downstream side in a transport direction than the fixing device 30.

Additionally, a reversal transporting path 37 where the recording medium P that has the toner images fixed one side thereof is reversed and returned to the second transfer position T2 again is provided opposite (Y-direction side) to the intermediate transfer belt 24 with respect to the second transfer position T2 (transporting path 48). When images are formed on both sides of the recording medium P, the recording medium P that has the toner images fixed on one side thereof is switched back by the ejection roll 52, is guided to the reversal transporting path 37, and is fed back to the second transfer position T2.

Image Forming Operation

Next, an image forming operation of forming an image on the recording medium P in the image forming apparatus 10 related to the present exemplary embodiment will be described.

In the image forming apparatus 10 related to the present exemplary embodiment, the recording medium P accommodated in the accommodating section 70 is transported to the second transfer position T2 by the transporting device 60.

On the other hand, in the image forming units 22Y to 22K, the photoconductors 32 charged by the charging rolls 23 are exposed by the exposure device 36, and electrostatic latent images are formed on the photoconductors 32. The electrostatic latent images are developed by the developing device 38, and toner images are formed on the photoconductors 32. The toner images in respective colors formed by the image forming units 22Y to 22K overlap the intermediate transfer belt 24 at the respective first transfer positions T1, and thereby, a color image is formed. Then, the color image formed in the intermediate transfer belt 24 is transferred to the recording medium P at the second transfer position T2.

The recording medium P to which the toner images are transferred is transported to the fixing device 30, and the transferred toner images are fixed by the fixing device 30. When an image is formed only on one side of the recording medium P, the recording medium P is ejected to the ejection section 18 by the ejection roll 52 after the toner images are fixed. When images are formed on both sides of the recording medium P, the recording medium P is switched back by the ejection roll 52, is reversed, and then fed into the reversal transporting path 37 after an image is formed on one side. Further, the recording medium is fed to the second transfer position T2 from the reversal transporting path 37, an image is formed similar to the above on an opposite side of the recording medium where no image is recorded, images are formed on both sides of the recording medium P, and the recording medium is ejected to the ejection section 18 by the ejection roll 52. A series of image forming operations are performed as described above.

Configuration of Transporting Device 60

Figure 2:
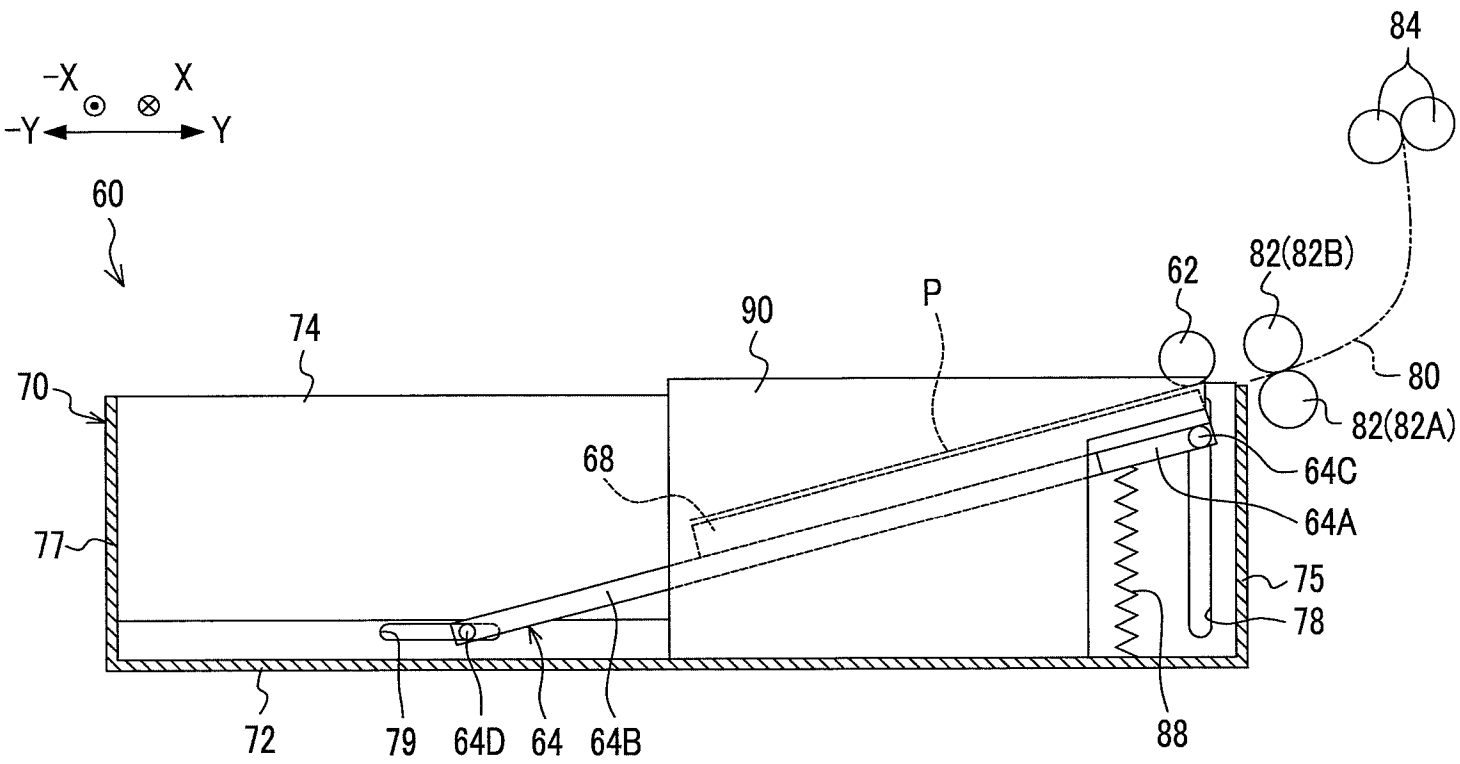
FIG. 2 is a cross-sectional side view showing the configuration of a transporting device related to the present exemplary embodiment.
Figure 3:
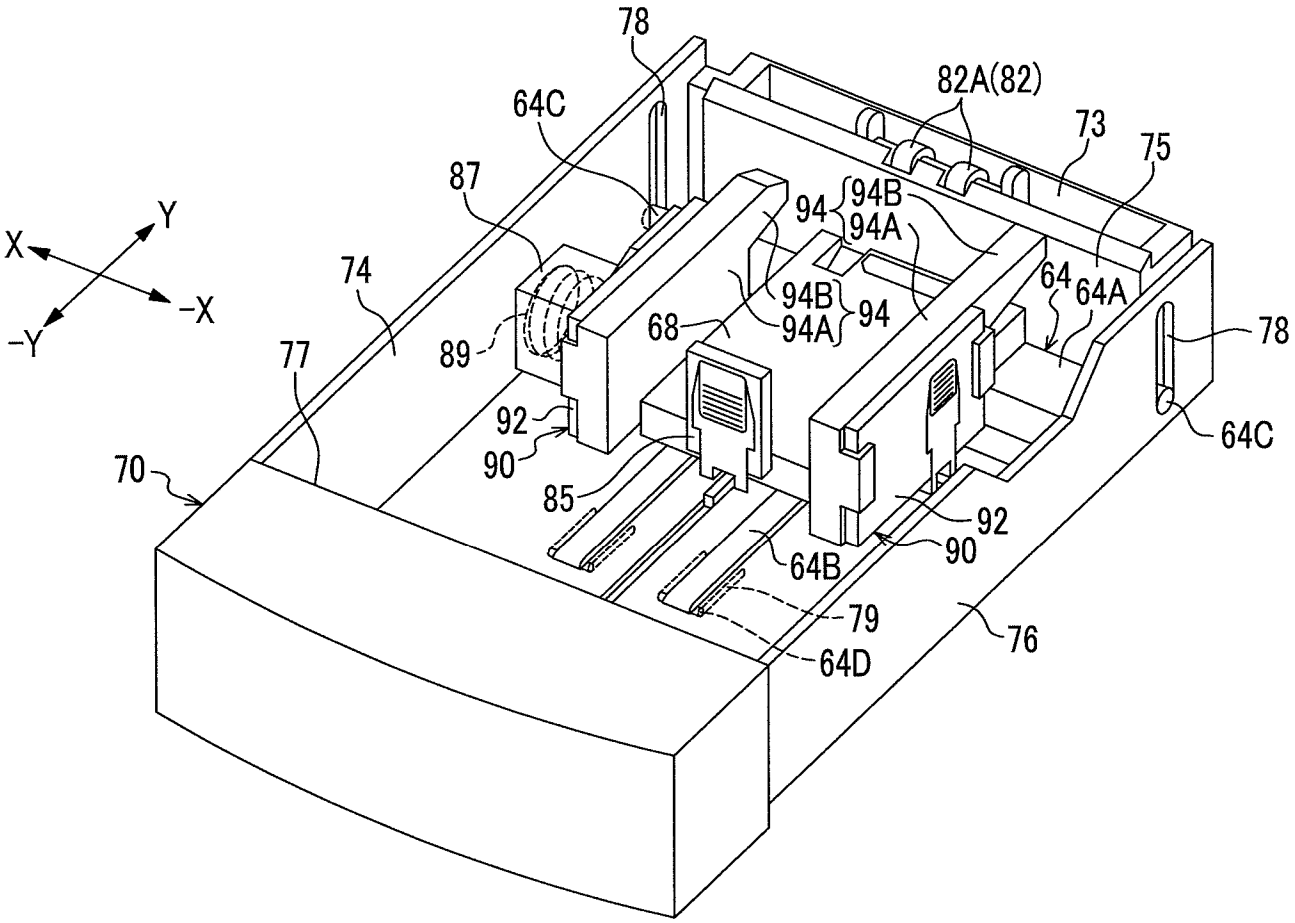
FIG. 3 is a perspective view showing the configuration of the transporting device related to the present exemplary embodiment.

Next, the configuration of the transporting device 60 will be described. FIG. 2 is a cross-sectional side view showing the configuration of the transporting device 60. FIG. 3 is a perspective view showing the configuration of the transporting device 60.

The transporting device 60, as shown in FIG. 2, has the accommodating section 70 that accommodates the recording medium P, a feed roll 62 (pickup roll) as an example of a transport section that transports the recording medium P accommodated in the accommodating section 70, and the bottom plate 64 as an example of a moving member on which the recording medium P accommodated in the accommodating section 70 is placed and that ascends and lifts the recording medium P at a contact position S (refer to FIG. 5) with the feed roll 62.

Moreover, the transporting device 60 has a pair of positioning members 90 (side guides) that contacts with a width-direction end portion (side end portion) of the recording medium P placed on the bottom plate 64, and positions the recording medium P in the width direction, and a table 68 that is arranged between the recording medium P and the bottom plate 64 and raises the position of the recording medium P in the vertical direction. That is, the table 68 is provided on an upper surface of the bottom plate 64, and the recording medium P is placed on the table 68. Accordingly, in the present exemplary embodiment, the recording medium P is placed on the bottom plate 64 via the table 68. In addition, the width direction (X direction) of the recording medium P is a direction orthogonal to the transport direction (Y direction) in which the recording medium P is transported by the feed roll 62.

The accommodating section 70 is provided so as to be removable (or capable of being pulled out) in the −Y direction and mountable in the Y direction (refer to FIG. 1) with respect to the image forming apparatus body 11.

The accommodating section 70, as shown in FIG. 3, is formed in the shape of a box that opens upward. That is, the accommodating section 70 has a bottom wall 72, and four side walls 74, 75, 76, and 77 arranged on the X-direction, −X-direction, Y-direction, and −Y-direction sides of the bottom wall 72.

Moreover, the accommodating section 70 has an outer wall 73 provided on the outer side (on the Y-direction side) of the side wall 75 in the Y direction. A transport resistance imparting roll 82A is provided between the outer wall 73 and the side wall 75. A portion of an outer periphery of the transport resistance imparting roll 82A (to be described below) is arranged above upper ends of the outer wall 73 and the side wall 74.

The portions of the side wall 74 and the side wall 76 on the Y-direction side are provided with elongated holes 78 having a length in an up-and-down direction. Shaft portions 64C (to be described below) of the bottom plate 64 are inserted into the elongated holes 78 so as to be movable along a length direction (up-and-down direction) of the elongated holes 78.

The bottom wall 72, as shown in FIG. 2, is formed with elongated holes 79 that open in the X direction and has a length in the Y direction. Shaft portions 64D (to be described below) of the bottom plate 64 are inserted into the elongated holes 79 so as to be movable along a length direction (the Y direction and the −Y direction) of the elongated holes 79.

Moreover, as shown in FIG. 3, a positioning member 85, which contacts with a trailing edge (−Y-direction end portion) of the recording medium P placed on the bottom plate 64 and positions the recording medium P in the −Y direction, is provided at the bottom wall 72 so as to be movable in the Y direction and the −Y direction.

In addition, as the recording medium P accommodated in the accommodating section 70, for example, a postcard is used. Additionally, the accommodating section 70 is used as an example as an accommodating section exclusively for a recording-medium P (for example, a postcard) with a specific size.

Specifically, as shown in FIG. 2, the feed roll 62 contacts with an upper surface of the recording medium P placed on the bottom plate 64 and feeds the recording medium P from the accommodating section 70.

A transporting path 80 along which the recording medium P fed by the feed roll 62 is transported and a feed roll pair 82 and a feed roll pair 84 (an example of a second transport section) that is arranged along the transporting path 80 to transport the recording medium P fed by the feed roll 62 to the second transfer position T2 are provided on the downstream side of the feed roll 62 in the transport direction.

The feed roll pair 82, specifically, is configured to have a transport force imparting roll 82B (feed roll) that is arranged on the upper side to impart a transport force to the recording medium P, and a transport resistance imparting roll 82A (retard roll) that is arranged on the lower side to impart a transport resistance to the recording medium P. In the feed roll pair 82, when plural sheets of recording media P are fed by the feed roll 62, the transport force imparting roll 82B imparts a transport force to an upper recording medium P, while the transport resistance imparting roll 82A imparts a transport resistance to a lower recording medium P. This allows the recording medium P to be separated and transported one by one. In addition, when one sheet of recording medium P is fed by the feed roll 62, the transport resistance imparting roll 82A is rotated in the following manner as a predetermined rotative force acts thereon from the recording medium P transported by the transport force imparting roll 82B, and transports the recording medium P together with the transport force imparting roll 82B.

The feed roll pair 84 (registration roll pair) has the function of aligning the leading edge of the recording medium P transported from the feed roll pair 82 in the width direction (the X direction), and then transporting the recording medium P to the second transfer position T2. Specifically, the feed roll pair 84, for example, is adapted to stop its driving in a predetermined period to thereby align the leading edge of the recording medium P in the width direction and then transport the recording medium P, even after the leading edge of the recording medium P transported from the feed roll pair 82 has reached the feed roll pair 84. In the present exemplary embodiment, the length from a second contact position where the feed roll pair 84 contacts with the recording medium P to a main body 92, to be described below, is longer than the shortest length of the length of the recording medium P in the transport direction by which the transporting device 60 allows transport. Moreover, the length from the second contact position to the end portion of an arranging member 94 (to be described below) on the downstream side in the transport direction is shorter than the shortest length of the length of the recording medium P in the transport direction by which the transport of the recording medium is allowed by the transporting device 60.

Figure 4:
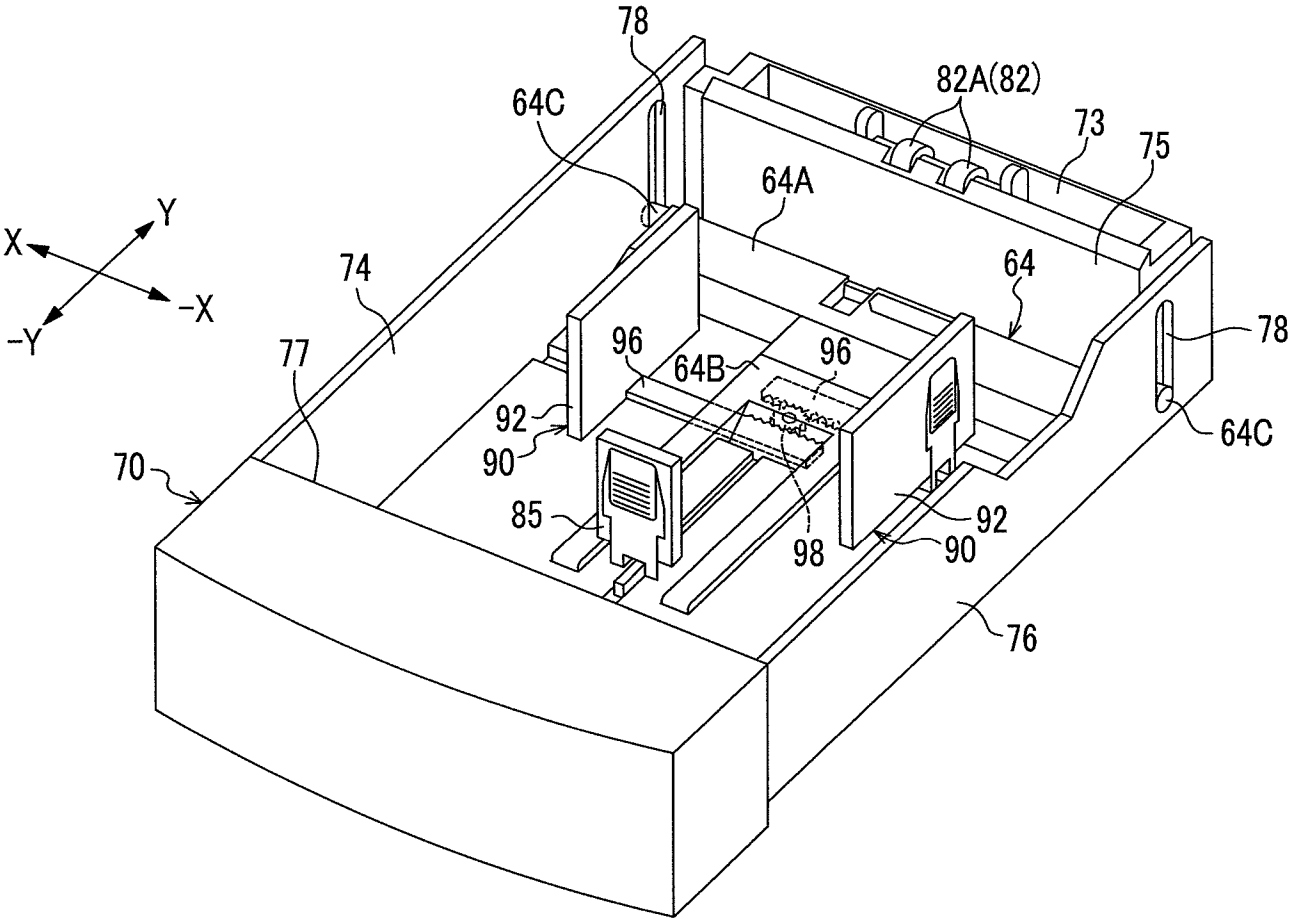
FIG. 4 is a perspective view showing a state where a table is removed from a bottom plate and an arranging member is removed from a main body in each positioning member, in the configuration shown in FIG. 3.

The bottom plate 64, as shown in FIG. 4, has a first plate 64A that has a length in the X direction in a Y-direction-side portion within the accommodating section 70, and a second plate 64B that extends in the −Y direction from a middle portion of the first plate 64A in its length direction. That is, the bottom plate 64 is formed in a substantially T-shape in a plan view. In addition, FIG. 4 shows a state where the table 68 is removed from the bottom plate 64 and the arranging member 94 is removed from the main body 92 in each positioning member 90.

The shaft portions 64C that protrude in the X direction and the −X direction are provided on an end surface of the first plate 64A in the X direction and on an end surface of the first plate in the −X direction, respectively. The shaft portions 64C are inserted so as to be movable along the length direction (up-and-down direction) of the elongated holes 78 of the side wall 74 and the side wall 76, respectively.

An end portion of the second plate 64B in the −Y direction, as shown in FIG. 2, is provided with the shaft portions 64D that protrude in the X direction and the −X direction. The shaft portions 64D are inserted so as to be movable along the length direction (the Y direction) of the elongated holes 79 of the bottom wall 72, respectively.

A coil spring 88 as a pressing member is provided between a portion (a portion on the first plate 64A side) of the bottom plate 64 in the Y-direction side, and the bottom wall 72. The coil spring 88 presses the bottom plate 64 upward. This allows the portion (the portion on the first plate 64A side) of the bottom plate 64 on the Y-direction side to ascend.

Also, in the bottom plate 64, when the portion (the portion on the first plate 64A side) on the Y-direction side ascends, the shaft portions 64C move upward and the shaft portions 64D move to the Y-direction side with this movement. Additionally, in the bottom plate 64, when the portion (the portion on the first plate 64A side) on the Y-direction side descends, the shaft portions 64C move downward and the shaft portions 64D move to the −Y-direction side with this movement.

In addition, the bottom plate 64 is provided with a holding mechanism (not shown) that lowers the bottom plate 64 and holds the bottom plate in the descent state with the operation in which the accommodating section 70 is removed (or pulled out) from the image forming apparatus body 11, and a releasing mechanism (not shown) that releases the holding of the holding mechanism with the operation in which the accommodating section 70 is mounted on the image forming apparatus body 11.

Each of the pair of positioning members 90, as shown in FIG. 3, has the main body 92, and the arranging member 94 having an arranging part 94B extending from the main body 92 to the downstream side (Y-direction side) in the transport direction in a side view.

The pair of main bodies 92 are provided at the bottom wall 72 so as to be movable in the X direction and the −X direction of the second plate 64B of the bottom plate 64, respectively. Each of the main bodies 92, as shown in FIG. 4, is provided with a rack 96 that engages with a pinion 98 provided at the middle portion of the bottom wall 72 in the X direction. As a result, when one main body 92 moves in the X direction, the other main body 92 moves in the −x direction with this movement.

Each of the pair of arranging members 94 is configured to have a member separate from the main body 92, and is mounted on the main body 92 (refer to FIG. 3 (after mounting) and FIG. 4 (before mounting)). Each of the pair of arranging members 94 has a positioning portion 94A arranged on the second plate 64B side with respect to the main body 92, and the arranging part 94B extending from the positioning portion 94A to the downstream side (Y-direction side) in the transport direction.

The positioning portion 94A is adapted to contact with a side end portion (width-direction end portion) of the recording medium P placed on the bottom plate 64, in the upstream side (−Y-direction side) in the transport direction with respect to the feed roll 62 and to position the recording medium P in the width direction.

Figure 5:
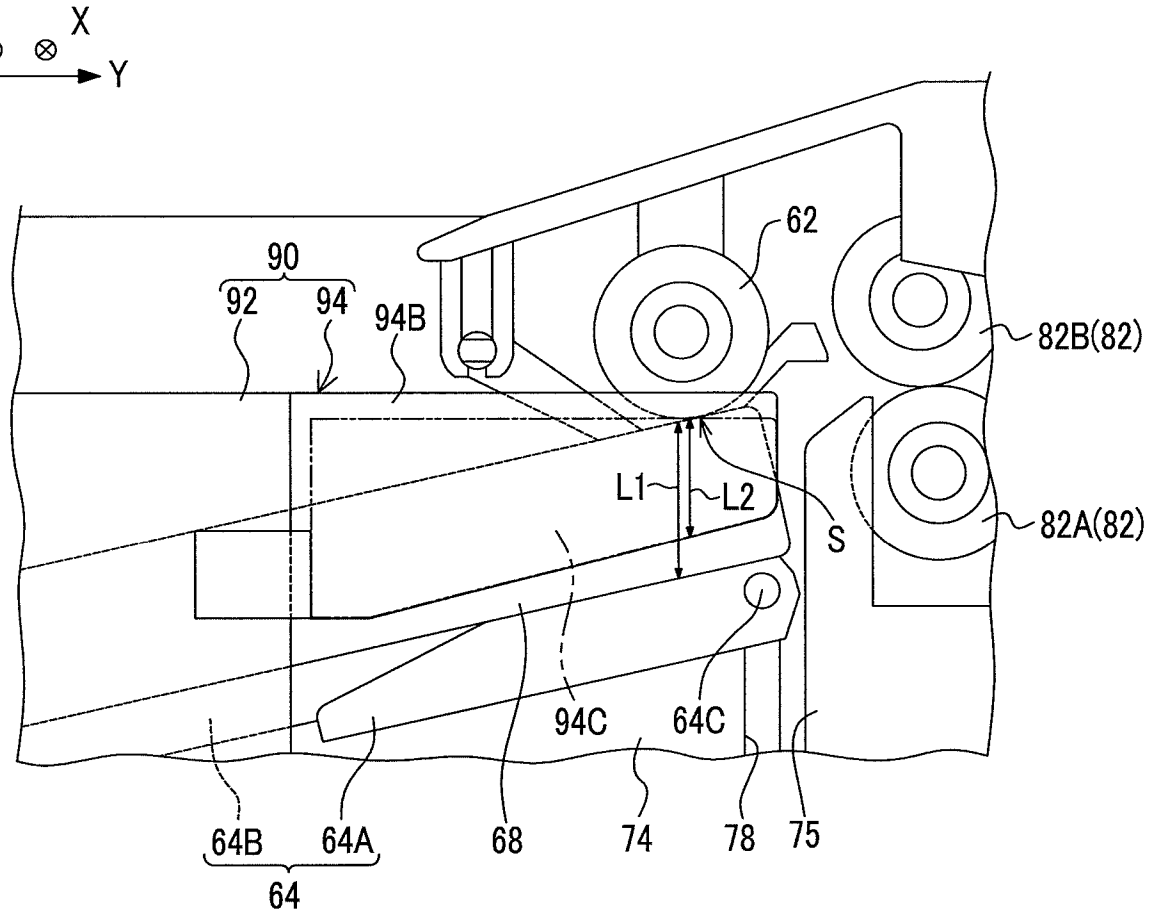
FIG. 5 is an enlarged side view showing the periphery of an arranging part related to the present exemplary embodiment.

The arranging part 94B is adapted to contact with a side end portion (width-direction end portion) of the recording medium P placed on the bottom plate 64, in the downstream side (Y-direction side) in the transport direction with respect to the positioning portion 94A and to position the recording medium P in the width direction. Moreover, the arranging part 94B, as shown in FIG. 5, extends further toward the downstream side in the transport direction than the contact position S of the feed roll 62. Accordingly, the arranging part 94B is adapted to position the recording medium P in the width direction at the contact position S of the feed roll 62 and on the downstream side of the contact position S. That is, the trailing edge of the recording medium P after being transporting by the feed roll 62 (after being left out of the feed roll 62) is guided along the transport direction (Y direction).

The arranging part 94B has an arranging portion 94C that is arranged below the contact position S on an ascent side of the first plate 64A of the bottom plate 64. That is, the arranging portion 94C is arranged so as to overlap the first plate 64A of the bottom plate 64 in a plan view. The arranging portion 94C is a portion where the bottom plate 64 contacts with and a gap is formed between the bottom plate 64 and the feed roll 62 before the bottom plate 64 has reached the contact position S when the bottom plate 64 on which the table 68 is not mounted ascends. That is, the arranging part 94B is arranged at a position where the arranging part contacts with the bottom plate 64 and a gap is formed between the bottom plate 64 and the feed roll 62, when the bottom plate 64 on which the table 68 is not mounted has moved toward the contact position S.

Figure 6:
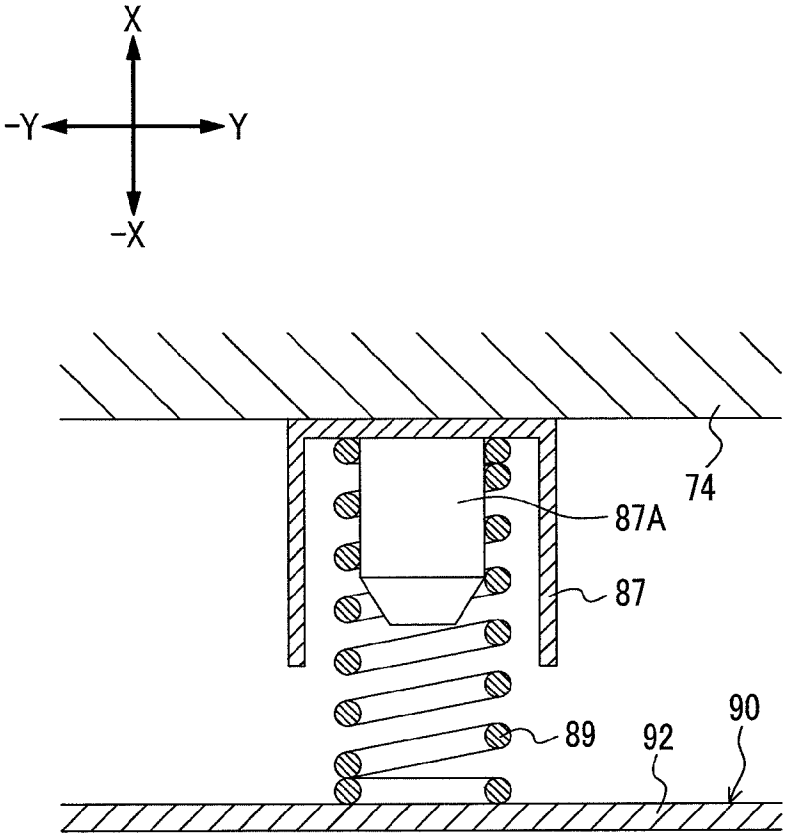
FIG. 6 is a cross-sectional plan view showing the configuration of a coil spring that pushes the positioning member related to the present exemplary embodiment.

Outside (X-direction side) the positioning member 90, which is arranged on the X-direction side, out of the pair of positioning members 90, as shown in FIG. 3, a coil spring 89 (an example of the pressing member) that presses the positioning member 90 toward the recording medium P (−X-direction side) placed on the bottom plate 64 is provided. The coil spring 89, as shown in FIG. 6, is housed in a housing container 87, and is mounted so as to be fitted to a shaft portion 87A within the housing container 87. Moreover, the movement of the positioning member 90 to the outside (side apart from the table 68) is regulated by the housing container 87. That is, when the positioning member 90 moves to the outside (side apart from the table 68), the positioning member contacts with the housing container 87 and movement to the outside beyond the hitting position is regulated. In addition, the positioning members 90 are located further toward the inner side (middle side in the length direction) than both ends of the first plate 64A of the bottom plate 64 in the length direction at the hitting position.

The table 68 is configured to have a member separate from the bottom plate 64, and is mounted on the upper side of the bottom plate 64 (refer to FIG. 3 (after mounting) and FIG. 4 (before mounting)). This allows the bottom plate 64 to ascend or descend integrally with the table 68. Specifically, this table 68 is formed in the shape of a plate having a thickness in the up-and-down direction. Moreover, the table 68 has a rectangular shape in a plan view.

The thickness (a length L1 along the vertical direction in a state where the feed roll 62 contacts with the contact position S) of the table 68, as shown in FIG. 5, is made equal to or more than a length L2 along the vertical direction of the arranging portion 94C. Additionally, the width-direction length of the table 68 along the width direction of the recording medium P is made shorter than the width-direction length of the recording medium P. Specifically, the width-direction length of the table is made shorter than the shortest length of the width-direction length of the recording medium P by which the transporting device 60 allows transport. Moreover, specifically, the width-direction length of the table 68 is shortened beyond the range of a dimensional error allowed in the width direction of the recording medium P and the table 68.

This allows the table 68 to be settled between the pair of positioning members 90. That is, the table 68 is arranged further toward the recording medium P side than the positioning members 90 in the X direction. Accordingly, the table 68 does not overlap the arranging portion 94C in a plan view. Moreover, the table 68 is arranged so as to overlap the feed roll 62 in a plan view (viewed in the vertical direction). Additionally, the table 68 is provided so that an upper surface thereof becomes higher in the vertical direction than the bottom plate 64.

Actions and Effects Related to Present Exemplary Embodiment

Next, actions and effects related to the present exemplary embodiment will be described.

In the present exemplary embodiment, the accommodating section 70 is held in a descent state where the bottom plate 64 and the table 68 have descended by the holding mechanism (not shown) in a state where the accommodating section 70 is removed (or pulled out) from the image forming apparatus body 11. In this state, an operator places the recording medium P on the table 68 within the accommodating section 70. Then, when the accommodating section 70 is mounted on the image forming apparatus body 11, the holding of the bottom plate 64 and the table 68 in the descent state is released by the releasing mechanism (not shown). As a result, as shown in FIG. 2, the bottom plate 64 and the table 68 are pushed and ascend upward by the coil spring 88.

Figure 7:
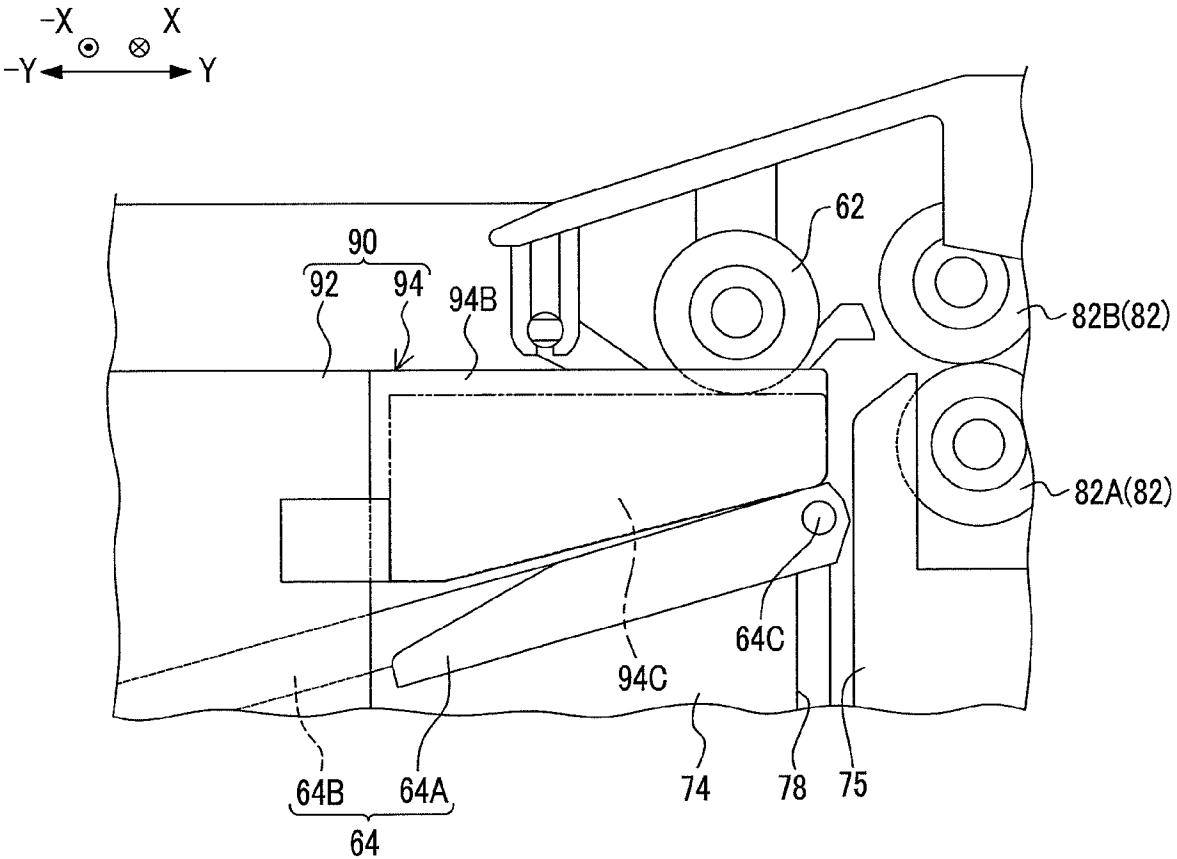
FIG. 7 is an enlarged side view showing the periphery of an arranging part related to a comparative example.

Here, in the present exemplary embodiment, the arranging part 94B of the positioning member 90 has the arranging portion 94C that is arranged below the contact position S on the ascent side of the first plate 64A of the bottom plate 64. For this reason, in the case of the comparative example in which the table 68 is not mounted on the bottom plate 64, when the bottom plate 64 ascends when the whole stacking height (length along the vertical direction) of plural recording media P placed on the bottom plate 64 is smaller than the thickness (length along the vertical direction) of the arranging portion 94C, as shown in FIG. 7, the bottom plate 64 contacts with the arranging portion 94C, and the bottom plate 64 and the arranging portion 94C interrupt each other. As a result, the bottom plate 64 may not ascend beyond a position where the bottom plate has interrupted with the arranging portion 94C, and the recording medium P placed on the bottom plate 64 may not be lifted to the contact position S with respect to the feed roll 62. Accordingly, the recording medium P may not be transported by the feed roll 62 and may not be fed from the accommodating section 70. In addition, illustration of the recording medium P is omitted in FIG. 7.

In contrast, in the present exemplary embodiment, the table 68 having a thickness equal to or more than the length of the arranging portion 94C along the vertical direction is mounted on the bottom plate 64, and the recording medium P is placed on the table 68. For this reason, even when the bottom plate 64 and the table 68 ascend, the bottom plate 64 does not interrupt the arranging portion 94C, and all of the recording media P placed on the table 68 are lifted to the contact position S with respect to the feed roll 62 (refer to FIG. 5). This allows all of the recording media P placed on the table 68 to be transported by the feed roll 62.

In addition, since the table 68 is adapted so as not to overlap the arranging portion 94C in a plan view, the table 68 does not interrupt the arranging portion 94C even when the table 68 ascends.

Additionally, in the present exemplary embodiment, the arranging part 94B extending from the positioning portion 94A to the downstream side in the transport direction contacts with the width-direction end portion of the recording medium P to position the recording medium P in the width direction. That is, the recording medium P is effectively guided along the transport direction (Y direction). Accordingly, compared to a case where the arranging part 94B is not included, skewing in which the recording medium P transported by the feed roll 62 inclines with respect to the transport direction is suppressed.

Moreover, in the present exemplary embodiment, the arranging part 94B extends to the downstream side in the transport direction with respect to the contact position S of the feed roll 62. For this reason, the trailing edge of the recording medium P after being left out of the feed roll 62 is also effectively guided along the transport direction (Y direction). This effectively suppresses the skewing of the recording medium P. Particularly, in the present exemplary embodiment, the length from the second contact position where the feed roll pair 84 contacts with the recording medium P to the main body 92 is longer than the shortest length of the transport-direction length of the recording medium P by which the transporting device 60 allows transport. However, the length from the second contact position to the end portion of the arranging member 94 on the downstream side in the transport direction is shorter than the shortest length of the transport-direction length of the recording medium P by which the transporting device 60 allows transport. For this reason, even when the recording medium P (for example, a postcard or the like) whose transport-direction length is the shortest is transported, the recording medium P is guided along the transport direction by the arranging member 94, and the skewing is effectively suppressed.

Additionally, in the present exemplary embodiment, the width-direction length of the table 68 is made shorter than the width-direction length of the recording medium P beyond the range of a dimensional error allowed in the width direction of the recording medium P and the table 68.

As a result, compared to the case where the width-direction length of the table 68 along the width direction of the recording medium P is the same as the width-direction length of the recording medium P, poor positioning of the recording medium P is suppressed even when there is any dimensional error in the width direction of the recording medium P and the table 68.

That is, even when the width-direction dimension of the recording medium P is smaller than a regular dimension, the width-direction dimension of the recording medium P does not become smaller than the width-direction dimension of the table 68, and the positioning portions 94A of the positioning members 90 contact with the side end portions of the recording medium P, and thus the recording medium P is positioned in the width direction. Additionally, even when the width-direction dimension of the table 68 is larger than a regular dimension, the width-direction dimension of the table 68 does not become smaller than the width-direction dimension of the recording medium P, and the positioning portions 94A of the positioning members 90 contact with the side end portions of the recording medium P, and thus, the recording medium P is positioned in the width direction.

Additionally, in the present exemplary embodiment, the coil spring 89 presses the positioning members 90 toward the recording medium P (−X-direction side) placed on the bottom plate 64. As a result, compared to a case where no coil spring 89 is included, a state where the positioning members 90 contact with the side end portions of the recording medium P is maintained.

Moreover, in the present exemplary embodiment, the table 68 is configured to have a member separate from the bottom plate 64. For this reason, parts may be commonalized in the bottom plate 64 in the present exemplary embodiment and the bottom plate 64 in a transporting device having a configuration in which the table 68 is not included.

Moreover, in the present exemplary embodiment, the arranging member 94 is configured to have a member separate from the main body 92. For this reason, parts may be commonalized in the main body 92 in the present exemplary embodiment and the main body 92 in the transporting device having the configuration in which the arranging member 94 is not included. In addition, in the transporting device having the configuration in which the arranging member 94 is not included, for example, the main body 92 in the present exemplary embodiment functions as the positioning portion that positions the side end portion of the recording medium P.

Modification Example

In the above exemplary embodiment, the arranging part 94B has the arranging portion 94C. However, the invention is not limited to this, and any portion of the positioning member 90 may be the arranging portion 94C.

In the above exemplary embodiment, the thickness of the table 68 is a thickness equal to or more than the length of the arranging portion 94C along the vertical direction. However, the thickness of the table is not limited to this, and may be a thickness less than the length of the arranging portion 94C along the vertical direction. According to this configuration, compared to the comparative example in which the table 68 is not mounted on the bottom plate 64, the number of the recording media P that may not be transported by the feed roll 62 among the recording media P placed on the bottom plate 64 (table 68) is reduced.

In the above exemplary embodiment, the width-direction length of the table 68 is made shorter than the width-direction length of the recording medium P. However, the invention is not limited to this, and the width-direction length of the table 68 along the width direction of the recording medium P may be the same as the width-direction length of the recording medium P.

In the above exemplary embodiment, the positioning portion 94A that contacts with the side end portion (width-direction end portion) of the recording medium P placed on the bottom plate 64 to position the recording medium P in the width direction is formed at the arranging member 94. However, the invention is not limited to this, and the positioning portion 94A may be formed at the main body 92.

In the above exemplary embodiment, the table 68 is configured to have a member separate from the bottom plate 64. However, the invention is not limited to this, and the table 68 may be constituted integrally with the bottom plate 64.

In the above exemplary embodiment, the arranging member 94 is configured to have a member separate from the main body 92. However, the invention is not limited to this, and the arranging member 94 may be constituted integrally with the main body 92.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transporting device comprising:

a transport section that contacts with a material to be transported and that transports the material to be transported;

a table on which the material to be transported is placed;

a moving member that includes the table provided on an upper surface of the moving member so that an upper surface of the table is higher than the upper surface of the moving member in a vertical direction and moves the material to be transported, which is placed on the table, to a contact position where the material to be transported contacts with the transport section; and a positioning member that contacts with an end portion of the material to be transported in a width direction orthogonal to a transport direction in which the material to be transported is transported by the transport section, wherein the positioning member includes an arranging part arranged at a position where the arranging part contacts with the moving member and a gap is formed between the moving member and the transport section when the moving member is moved toward the contact position, wherein the positioning member includes:

a main body that is movable along the width direction of the material to be transported; and an arranging member that is constituted by a member separated from the main body and that includes the arranging part, wherein the arranging member is detachably provided at the main body, wherein the arranging member extends in the transport direction, and wherein the table is provided at a position nearer to the material to be transported than the positioning member in the width direction and overlaps the transport section when being viewed in the vertical direction.

2. The transporting device described in claim 1, wherein the length of the table along the width direction is shorter than the shortest length of the length of the material to be transported in the width direction allowed in the transporting device.

3. The transporting device according to claim 2, wherein the table is constituted by a member separated from the moving member and is detachably provided at the moving member.

4. An image forming apparatus comprising:

the transporting device according to claim 2 that transports a recording medium as the material to be transported; and an image forming section that forms an image on the material to be transported that is transported by the transporting device.

5. The transporting device according to claim 1, wherein the table is constituted by a member separated from the moving member and is detachably provided at the moving member.

6. The transporting device according to further comprising:

a second transport section that is provided further toward a downstream side in a transport direction than the transport section and that contacts with the material to be transported, which is transported from the transport section, and transports the material to be transported, wherein the length from a second contact position where the second transport section contacts with the material to be transported to the main body is longer than the shortest length of the length of the material to be transported in the transport direction allowed in the transporting device, and wherein the length from the second contact position to an end portion of the arranging member on the downstream side in the transport direction is shorter than the shortest length of the length of the material to be transported in the transport direction allowed in the transporting device.

7. An image forming apparatus comprising:

the transporting device according to claim 1 that transports a recording medium as the material to be transported; and an image forming section that forms an image on the material to be transported that is transported by the transporting device.

8. The transporting device according to claim 1, wherein the table is integrally constituted with the member.

* * * * *